US009528517B2

(12) United States Patent
Ahire et al.

(10) Patent No.: US 9,528,517 B2
(45) Date of Patent: Dec. 27, 2016

(54) ALIGNMENT FEATURE FOR A LOWER BEARING ASSEMBLY FOR A SCROLL COMPRESSOR

(71) Applicant: Emerson Climate Technologies, Inc., Sidney, OH (US)

(72) Inventors: Pankaj Nimbaji Ahire, Pune (IN); Vinayak Madanrao Juge, Pune (IN); Sunil A. Magadum, Pune (IN); Natalie Gehret, Yorkshire, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 140 days.

(21) Appl. No.: 14/356,063

(22) PCT Filed: Mar. 7, 2014

(86) PCT No.: PCT/IN2014/000152

§ 371 (c)(1),
(2) Date: May 2, 2014

(87) PCT Pub. No.: WO2014/141297

PCT Pub. Date: Sep. 18, 2014

(65) Prior Publication Data

US 2015/0275898 A1 Oct. 1, 2015

(30) Foreign Application Priority Data

Mar. 13, 2013 (IN) ..... 753/MUM/2013

(51) Int. Cl.
*F01C 1/02* (2006.01)
*F03C 2/00* (2006.01)
(Continued)

(52) U.S. Cl.
CPC ..... *F04C 23/008* (2013.01); *F01C 1/0215* (2013.01); *F04C 18/0215* (2013.01);
(Continued)

(58) Field of Classification Search
CPC ... F04C 18/0215; F04C 23/008; F04C 27/005; F04C 29/023; F04C 29/025; F04C 29/028; F04C 2240/40; F04C 2240/50; F04C 2240/60; F04C 2240/807; F04C 2240/809; F01C 1/0215
(Continued)

(56) References Cited

U.S. PATENT DOCUMENTS 4,609,334 A * 9/1986 Muir ..... F04C 23/008 418/55.2
4,767,293 A * 8/1988 Caillat ..... F04C 18/0215 418/55.3
(Continued)

FOREIGN PATENT DOCUMENTS

CN 2758531 Y 2/2006
CN 101636588 A 1/2010
(Continued)

OTHER PUBLICATIONS

International Search Report regarding Application No. PCT/IN2014/000152, mailed Dec. 10, 2014.
(Continued)

*Primary Examiner* — Theresa Trieu
(74) *Attorney, Agent, or Firm* — Harness, Dickey & Pierce, P.L.C.

(57) ABSTRACT

A compressor including a shell, and a compression mechanism disposed in the shell including a first scroll member having a first spiral wrap and a second scroll member having a second spiral wrap intermeshed with the first spiral wrap. A drive shaft has a first end engaged with the first scroll member for moving the first scroll member relative to the second scroll member, and a bearing assembly including a bearing housing rotatably supports a second end of the drive shaft. A base is secured to the shell, and a mounting feature
(Continued)

formed on either the bearing assembly or the base orients the bearing assembly relative to the base.

22 Claims, 3 Drawing Sheets

(51) Int. Cl.

| | |
|---|---|
| ***F03C 4/00*** | (2006.01) |
| ***F04C 2/00*** | (2006.01) |
| ***F04C 23/00*** | (2006.01) |
| ***F04C 29/02*** | (2006.01) |
| ***F04C 18/02*** | (2006.01) |

(52) U.S. Cl.
CPC ..... *F04C 29/023* (2013.01); *F04C 29/025* (2013.01); *F04C 29/028* (2013.01); *F04C 2240/50* (2013.01); *F04C 2240/807* (2013.01); *F04C 2240/809* (2013.01)

(58) Field of Classification Search
USPC ..... 418/88, 94, 55.1–55.6, 57, 151, 98
See application file for complete search history.

(56) References Cited

U.S. PATENT DOCUMENTS

| | | | | |
|---|---|---|---|---|
| 5,593,294 | A * | 1/1997 | Houghtby | F04C 28/28 418/55.1 |
| 6,247,909 | B1 | 6/2001 | Williams et al. | |
| 6,322,339 | B1 * | 11/2001 | Mitsunaga | F04C 18/0215 418/55.6 |
| 6,428,296 | B1 * | 8/2002 | Elson | F04C 18/0215 418/55.6 |
| 6,457,562 | B1 | 10/2002 | Sun | |
| 6,560,868 | B2 | 5/2003 | Milliff et al. | |
| 7,413,423 | B2 * | 8/2008 | Bonifas | F04C 23/008 418/55.6 |
| 7,717,687 | B2 | 5/2010 | Reinhart | |
| 2009/0035168 | A1 | 2/2009 | Ginies et al. | |
| 2009/0136372 | A1 * | 5/2009 | Elson | F04C 18/0215 418/55.6 |
| 2010/0233001 | A1 | 9/2010 | Jin | |

FOREIGN PATENT DOCUMENTS

| | | |
|---|---|---|
| CN | 201794741 U | 4/2011 |
| CN | 201874815 | 6/2011 |
| EP | 0341407 | 11/1989 |

OTHER PUBLICATIONS

Written Opinion of the International Searching Authority regarding Application No. PCT/IN2014/000152, mailed Dec. 10, 2014.

Office Action regarding Chinese Patent Application No. 201480000898.0, dated Mar. 2, 2016. Translation provided by Unitalen Attorneys at Law.

* cited by examiner

ALIGNMENT FEATURE FOR A LOWER BEARING ASSEMBLY FOR A SCROLL COMPRESSOR

FIELD

The present disclosure relates to scroll compressors.

BACKGROUND

This section provides background information related to the present disclosure which is not necessarily prior art.

Compressors can be driven by an electric motor including a rotor and a stator. The rotor may be fixed to a drive shaft that drives a compression mechanism of the compressor, and the stator may be press fit to an interior surface of a shell of the compressor. An air gap can be present between the rotor and the stator to allow for rotation of the rotor and drive shaft relative to the stator. Manufacturing tolerances, however, can sometimes cause misalignment of the rotor and drive shaft relative to the stator, which can cause undesired contact between the rotor and the stator.

SUMMARY

This section provides a general summary of the disclosure, and is not a comprehensive disclosure of its full scope or all of its features.

The present disclosure, in a first embodiment, provides a compressor including a shell, and a compression mechanism disposed in the shell including a first scroll member having a first spiral wrap and a second scroll member having a second spiral wrap intermeshed with the first spiral wrap. A drive shaft has a first end engaged with the first scroll member for moving the first scroll member relative to the second scroll member, and a bearing assembly including a bearing housing rotatably supports a second end of the drive shaft. A base is secured to the shell, and a mounting feature formed on either the bearing assembly or the base orients the bearing assembly relative to the base.

In the first embodiment, the base may include an aperture, and the bearing assembly is disposed at the aperture.

In the first embodiment, the aperture of the base may be defined by upwardly extending walls of the base.

In the first embodiment, the bearing assembly may include the mounting feature, and the mounting feature may be defined by a radially outwardly extending flange of the bearing housing.

In the first embodiment, the upwardly extending walls may include at least one port in communication with an interior of the shell.

In the first embodiment, the bearing housing may include at least one port in communication with an interior of the shell.

In the first embodiment, the bearing assembly may also include a thrust member disposed in the bearing housing that supports the drive shaft.

In the first embodiment, the bearing assembly may also include a lower bearing disposed between the bearing housing and the drive shaft.

In the first embodiment, the bearing housing may include a plurality of ports in communication with an oil sump located in the shell.

In the first embodiment, the base may include upwardly extending walls that define an aperture at which the bearing assembly is fixed, wherein the upwardly extending walls having a plurality of ports formed therein that communicate with an oil sump located in the shell.

The present disclosure, in a second embodiment, provides a compressor including a shell, a compression mechanism including a first scroll member having a first spiral wrap and a second scroll member having a second spiral wrap intermeshed with the first spiral wrap, an upper bearing assembly for supporting the compression mechanism, a drive shaft having a first end rotatably supported in the upper bearing assembly and engaged with the first scroll member for moving the first scroll member relative to the second scroll member, a lower bearing assembly including a bearing housing for rotatably supporting a second end of the drive shaft, a base secured to the shell, a mounting feature formed on the bearing housing to orient the bearing housing relative to the base, and an alignment feature formed on the bearing housing to orient the base and the lower bearing assembly relative to the upper bearing assembly.

In the second embodiment, the base may include an aperture, and the lower bearing assembly may be disposed at the aperture.

In the second embodiment, the aperture of the base may be defined by upwardly extending walls of the base.

In the second embodiment, the mounting feature may be defined by a radially outwardly extending flange of the bearing housing.

In the second embodiment, the alignment feature may be defined by a recessed portion formed in the bearing housing.

In the second embodiment, the upwardly extending walls may include at least one port in communication with an interior of the shell.

In the second embodiment, the bearing housing may include at least one port in communication with an interior of the shell.

In the second embodiment, a thrust member may be disposed in the bearing housing that supports the drive shaft.

In the second embodiment, a lower bearing may be disposed between the bearing housing and the drive shaft.

In the second embodiment, the bearing housing may include a plurality of ports in communication with an oil sump located in the shell.

In the second embodiment, the base may include upwardly extending walls that define an aperture at which the bearing assembly is fixed, and the upwardly extending walls may have a plurality of ports formed therein that communicate with an oil sump located in the shell.

The present disclosure also provides, in a third embodiment, a compressor including shell, a compression mechanism disposed in the shell, a drive shaft for driving the compression mechanism, a bearing assembly for supporting the drive shaft, and a bearing assembly oil sump for providing oil to the drive shaft.

In the third embodiment, a base may be coupled to the shell, wherein the bearing assembly is fixed to the base.

In the third embodiment, the base may include an aperture, and the bearing assembly may include a mounting feature that is secured to the aperture.

In the third embodiment, the base may include an aperture that defines a mounting feature, and the bearing assembly may be secured to the mounting feature.

In the third embodiment, the bearing assembly oil sump may include a plurality of ports in communication with an interior of the compressor.

In the third embodiment, the base may include an aperture that defines a mounting feature, the bearing assembly may be secured to the mounting feature, and the plurality of ports may be formed in the mounting feature.

In the third embodiment, the bearing assembly may include a bearing housing, a lower bearing, and a thrust member.

In the third embodiment, the bearing housing may include a mounting feature for securing the bearing assembly to a base of the shell.

In the third embodiment, the base may include an aperture, and the mounting feature may be secured to the aperture.

In the third embodiment, the mounting feature may be defined by a flange that extends radially in a direction away from an axis of the bearing assembly.

In the third embodiment, the lower bearing may include at least one slot, and the thrust member may include a tab that corresponds to and engages with the slot.

In the third embodiment, the compression mechanism may include a movable scroll member and a non-movable scroll member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3:
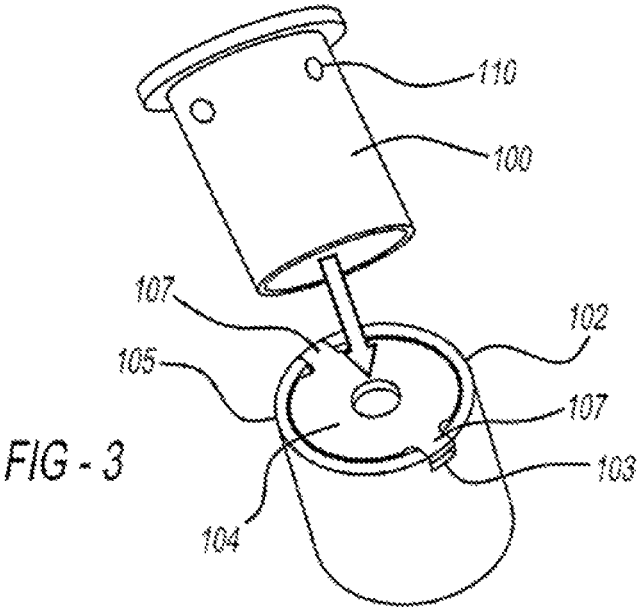
Figure 4:
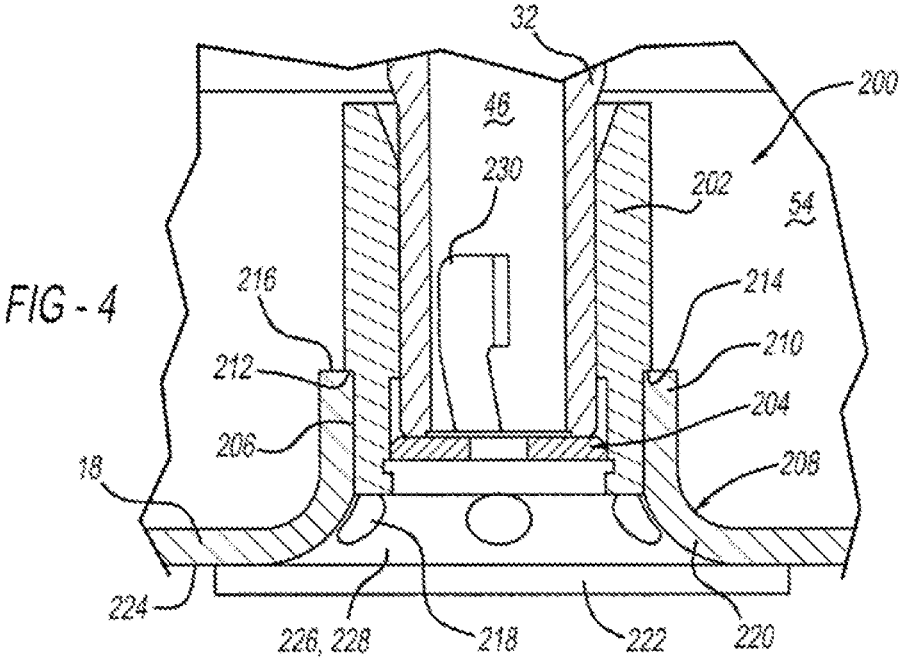
Figure 5:
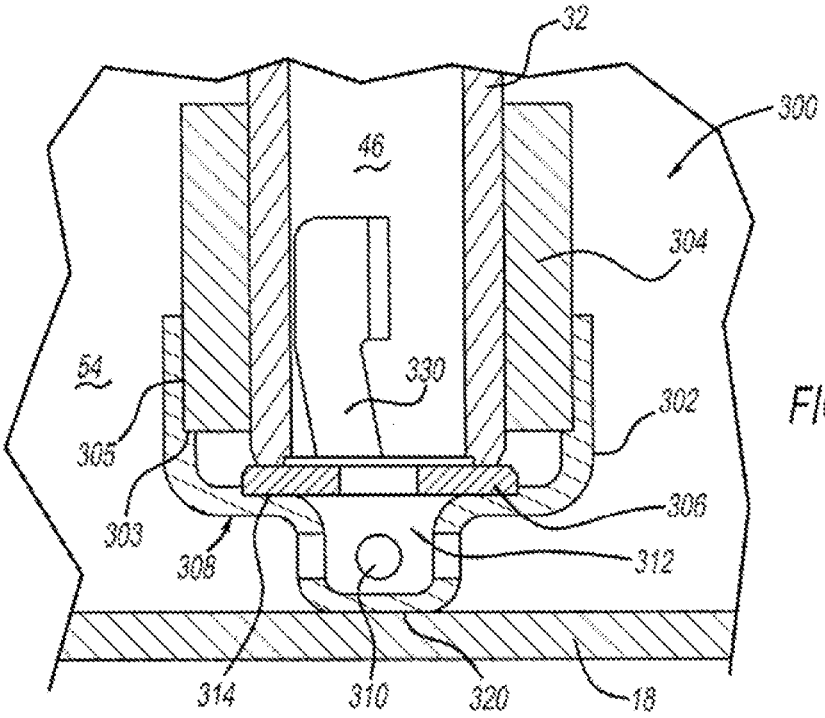

FIG. 3 is a partial exploded perspective view of a lower bearing assembly according to a principle of the present disclosure that also illustrates an exemplary method of assembly FIG. 4 is a cross-sectional view of another lower bearing assembly according to a principle of the present disclosure; and FIG. 5 is a cross-sectional view of yet another lower bearing assembly according to a principle of the present disclosure.

Corresponding reference numerals indicate corresponding parts throughout the several views of the drawings.

DETAILED DESCRIPTION

Example embodiments will now be described more fully with reference to the accompanying drawings.

Figure 1:
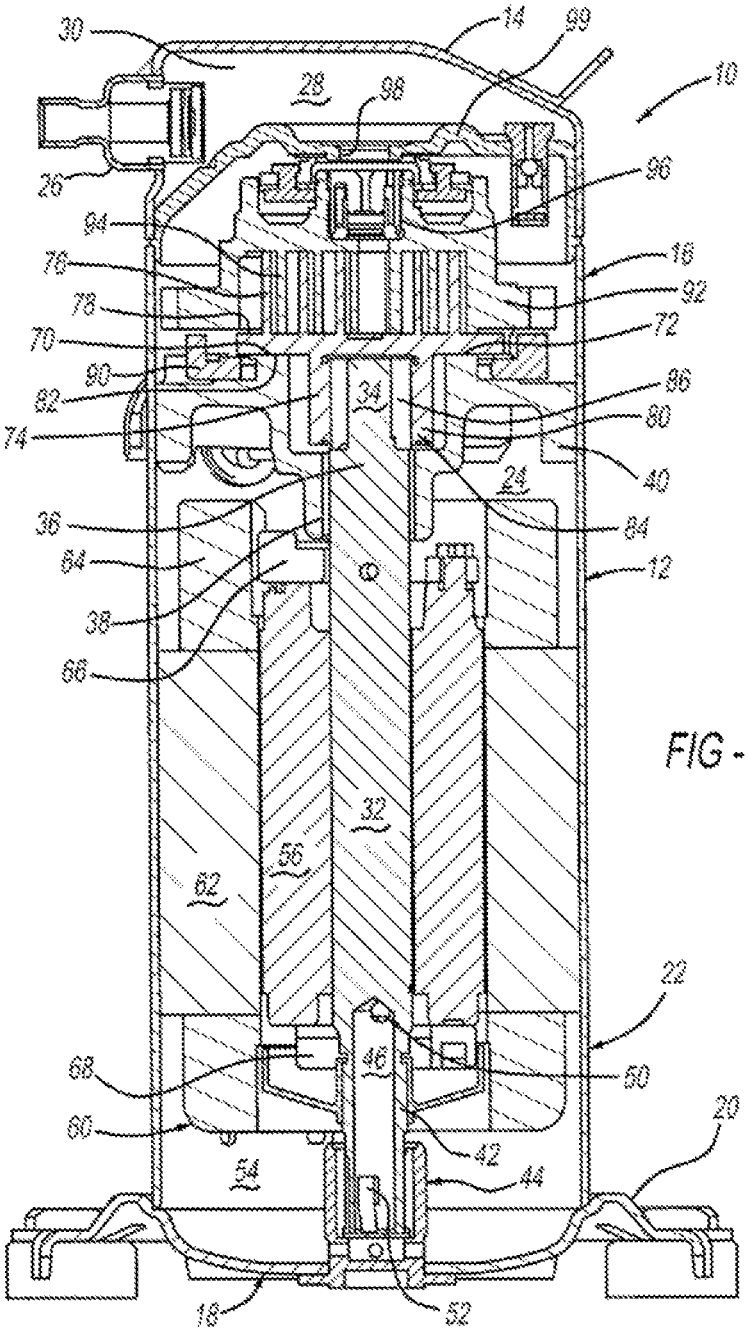
FIG. 1 is a cross-sectional view of a compressor according to a principle of the present disclosure.

With particular reference to FIG. 1, the compressor 10 is shown to include a generally cylindrical hermetic shell 12 having a welded cap 14 at a top portion 16 and a base 18 having a plurality of feet 20 welded at a bottom portion 22. The cap 14 and the base 18 are fitted to the shell 12 such that a suction volume 24 of the compressor 10 is defined. The cap 14 is provided with a discharge fitting 26 and an inlet fitting (not shown), disposed generally between the cap 14 and base 18. The cap 14 and a partition plate 99 may define a discharge volume 28.

A drive shaft or crankshaft 32 having an eccentric crank pin 34 at the upper end 36 thereof is rotatably journaled in a bearing 38 in the main bearing assembly 40. A second end 42 of crankshaft 32 is disposed in a lower bearing assembly 44. The crankshaft 32 has a relatively large diameter concentric bore 46 at the second end 42 which communicates with a radially outwardly inclined small diameter bore 50 extending upwardly therefrom to the top of the crankshaft 32. A stirrer 52 is disposed within the bore 46. The lower portion of the interior shell 12 defines an oil sump 54 filled with lubricating oil to a level slightly below the lower end of a rotor 56, and the bore 50 acts as a pump to pump lubricating fluid up the crankshaft 32 and ultimately to all of the various portions of the compressor that require lubrication.

The crankshaft 32 is rotatably driven by an electric motor 60 including a stator 62 having windings 64 passing therethrough. The rotor 56 is press fitted on the crankshaft 32 and has upper and lower counterweights 66 and 68, respectively.

An upper surface 70 of the main bearing assembly 40 defines a flat thrust bearing surface 72 on which an orbiting scroll member 74 is disposed having a spiral vane or wrap 76 on an upper surface 78 thereof. A cylindrical hub 80 downwardly projects from a lower surface 82 of orbiting scroll member 74 which has a drive bearing 84 and a drive bushing 86.

An Oldham coupling 90 is provided positioned between the orbiting scroll member 74 and the main bearing assembly 40 and is keyed to the orbiting scroll member 74 and a non-orbiting scroll member 92 to prevent rotational movement of the orbiting scroll member 74.

Non-orbiting scroll member 92 also includes a wrap 94 positioned in meshing engagement with the wrap 76 of the orbiting scroll member 74. Non-orbiting scroll member 92 has a centrally disposed discharge passage 96, which communicates with an aperture 98 formed in outer surface of the partition 99. Aperture 98 is in fluid communication with the discharge fitting 26 such that compressed fluid exits the compressor 10. Non-orbiting scroll member 92 is designed to be fixedly mounted to bearing housing 40 by a fastener (not shown), however still allowing axial movement of non-orbiting scroll member 92.

Figure 2:
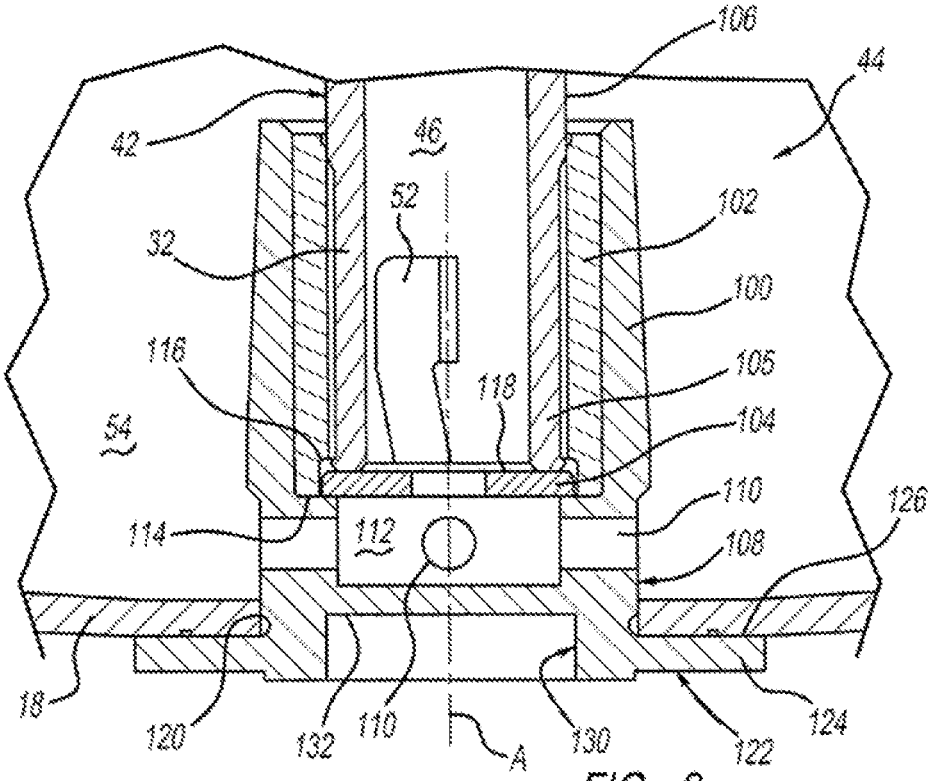
FIG. 2 is a cross-sectional view of a lower bearing assembly according to a principle of the present disclosure.

As best shown in FIGS. 2 and 3, lower bearing assembly 44, according to the present disclosure, can include a lower bearing housing 100, a lower bearing 102, and a spacer thrust member 104. Bearing housing 100 can include a cylindrical body that extends axially along a surface 106 of second end 42 of crankshaft 32. At an end 108 of bearing housing 100 can be formed a plurality of radially extending bores 110 that allow oil in sump 54 to enter bearing housing 100 and collect in a bearing sump 112. During rotation of crankshaft 32, oil can be pulled up from bearing sump 112 into large diameter concentric bore 46, which communicates with a radially outwardly inclined small diameter bore 50 extending upwardly there from to the top of the crankshaft 32. Oil is then provided to each of the moving surfaces (e.g., scroll members) within compressor 10. The location of the bores 110 can be well above the base 18, which may restrict solid contaminants from entering the bore 46.

Between bearing housing 100 and crankshaft 32 can be disposed lower bearing 102. Lower bearing 102 is a cylindrical member that provides a bearing surface for crankshaft 32. Each of bearing housing 100 and lower bearing 102 can be formed of any material known to one skilled in the art such as, for example, metal-backed polymers, polymers, powdered metals such as iron, steel, aluminum, and other metal materials that are satisfactory to withstand operation of compressor 10 and exposure to oil in sump 54. Lower bearing 102 can include a pair of diametrically opposed slots 103 formed at a base 105 of lower bearing 102. Slots 103 align with a pair of tabs 107 of spacer thrust member 104.

More specifically, a seat 114 of bearing housing 100 can be used to support spacer thrust member 104. As illustrated in FIG. 2, spacer thrust member 104 has a diameter less than a diameter of seat 114, but greater than an inner diameter of lower bearing 102. In this regard, lower bearing 102 can be formed to include a recessed shoulder 116 to accommodate spacer thrust member 104. In addition, as noted above, lower bearing 102 can include slots 103 that correspond to radially opposed tabs 107 of spacer thrust member 104. Slots 103 and tabs 107 allow for ease in assembling lower bearing assembly 44. It should be understood, however, that spacer thrust member 104 can have a diameter substantially equal to a diameter of seat 114 such that lower bearing 102 can rest upon an upper surface 118 of spacer thrust member 104. It should also be understood that spacer thrust member 104 can be omitted in favor of extending seat 114 radially in a direction toward an axis A of bearing housing 100 such that seat 114 can act as a thrust surface for crankshaft 32.

To secure lower bearing assembly 44 to base 18 of compressor 10, base 18 can include an aperture 120 that is engaged with mounting feature 122 of bearing housing 100. That is, bearing housing 100 can include mounting feature 122 defined by a mounting flange 124 that extends radially in a direction away from axis A of bearing housing 100. Mounting flange 124 can be secured to a lower surface 126 of base 18 by welding, brazing, or any other attachment method known to one skilled in the art. The use of aperture 120 and mounting feature 122 ensure proper alignment of crank shaft 32 and rotor 56 relative to stator 62. In this regard, stator 62 is generally press fit to shell 12, and an air gap should be present between rotor 56 and stator 62. By aligning lower bearing assembly 44 with aperture 120, proper alignment of crank shaft 32 and rotor 56, which is press fit to crank shaft 32, can be ensured relative to stator 62. Base 18 is provided with aperture 120 through which lower bearing assembly 44 is inserted from bottom side of compressor 10. Base 18, with lower bearing assembly 44 inserted into aperture 120, is then aligned with bearing assembly 38 with the assistance of an alignment feature 130. Alignment feature 130 can be in the form of a depression 132 formed in lower bearing housing 100. Alignment feature 130 can be engaged with a mounting jig (not shown) that properly aligns base 18 relative to shell 12. Once base 18 is properly aligned with shell 12 and bearing assembly 38, base 18 may then be welded to shell 12.

Now referring to FIG. 4, another lower bearing assembly 200 will be described. In FIG. 4, lower bearing assembly 200 can include a cylindrical bearing housing 202 and a spacer thrust member 204. Similar to the embodiment illustrated in FIGS. 2 and 3, lower bearing assembly 200 can be aligned with an aperture 206 formed in base 18. Aperture 206 formed in base 18, however, defines a mounting feature 208 for bearing housing 202. More particularly, mounting feature 208 is defined by upwardly extending walls 210 of base 18 that are designed to receive bearing housing 202. To ensure alignment between bearing housing 202 and upwardly extending walls 210 of base 18, bearing housing 202 can include a shoulder 214 that abuts a terminal end 216 of upwardly extending walls 210. Each of bearing housing 202 and spacer thrust member 204 can be formed of any material known to one skilled in the art such as, for example, powdered metals such as iron, steel, aluminum, and other metal materials that are satisfactory to withstand operation of compressor 10 and exposure to oil in sump 54.

Similar to the above-described embodiment of FIGS. 2 and 3, the use of aperture 206 that defines mounting feature 208 ensures proper alignment of crank shaft 32 and rotor 56 relative to stator 62. In this regard, stator 62 is generally press fit to shell 12, and an air gap should be present between rotor 56 and stator 62. By aligning lower bearing assembly 200 with aperture 206, proper alignment of crank shaft 32 and rotor 56, which is press fit to crank shaft 32, can be ensured relative to stator 62.

Although not illustrated in FIG. 4, it should be understood that bearing housing 202 can also include the features of at least one slot (not shown) that corresponds to radially at least one tab (not shown) of spacer thrust member 204. Slots and tabs allow for ease in assembling lower bearing assembly 200 in a manner similar to the embodiment illustrated in FIGS. 2 and 3.

To allow oil in sump 54 to enter lower bearing assembly 200, upwardly extending walls 210 of base 18 can include a plurality of oil ports 218 formed at a lower end 220 thereof. To ensure oil that enters ports 218 does not leak from compressor 10, a bottom cover plate 222 can be secured to a lower surface 224 of base 18 by welding, brazing, or any other method known to one skilled in the art. The space 226 between bottom cover plate 222 and bearing housing 202 can define a lower bearing sump 228. The bottom cover plate 222 may be concentrically and perpendicularly aligned with bearing housing 202. Then, the bottom cover plate 222 is concentrically aligned with the main bearing assembly 40. Therefore the bottom cover plate 222 is an alignment member for concentrically aligning bearing housing 202 and bearing 38.

Although not necessarily required by the present disclosure, lower bearing assembly 200 can also include an oil flinger 230 secured to thrust member 204. Oil flinger 230 can be formed separately from thrust member 204, or can be integral with thrust member 204. Oil flinger 230 assists in drawing oil from sump 54 into lower bearing sump 228 and into bore 46.

Now referring to FIG. 5, another configuration of a lower bearing assembly will be described. Lower bearing assembly 300 illustrated in FIG. 5 can include a cup-shaped bearing housing 302, a bearing bush 304, and a spacer thrust member 306. At an end 308 of bearing housing 302 can be formed a plurality of radially extending bores 310 that allow oil in sump 54 to enter bearing housing 302 and collect in a bearing sump 312. During rotation of crankshaft 32, oil can be pulled up from bearing sump 312 into large diameter concentric bore 46, which communicates with a radially outwardly inclined small diameter bore 50 extending upwardly therefrom to the top of the crankshaft 32.

Between bearing housing 302 and crankshaft 32 can be disposed bearing bush 304. Bearing bush 304 is a cylindrical member that provides a bearing surface for crankshaft 32. Each of bearing housing 302 and bearing bush 304 can be formed of any material known to one skilled in the art such as, for example, powdered metals such as iron, steel, aluminum, and other metal materials that are satisfactory to withstand operation of compressor 10 and exposure to oil in sump 54. To support bearing bush 304, bearing housing 302 can include a shoulder 303 formed at an inner diameter 305 thereof.

A seat 314 of bearing housing 302 can be used to support spacer thrust member 306. Spacer thrust member 306 can have a diameter less than a diameter of seat 314. It should be understood, however, that spacer thrust member 306 can have a diameter substantially equal to a diameter of seat 314. It should also be understood that spacer thrust member 306 can be omitted in favor of allowing seat 314 to act as a thrust surface for crankshaft 32.

To secure bearing assembly 300 to base 18, bearing housing 302 can be welded, brazed, or secured to base 18 at a surface 320 of bearing housing 302 that defines bearing sump 312. Although not necessarily required by the present disclosure, lower bearing assembly 300 can also include an oil flinger 330 secured to thrust member 306. Oil flinger 330 can be formed separately from thrust member 306, or can be integral with thrust member 306. Oil flinger 330 assists in drawing oil from sump 54 into lower bearing sump 312 and into bore 46.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A compressor, comprising:

a shell;

a compression mechanism including a first scroll member having a first spiral wrap and a second scroll member having a second spiral wrap intermeshed with the first spiral wrap;

a drive shaft having a first end engaged with the first scroll member for moving the first scroll member relative to the second scroll member;

a first bearing assembly rotatably supporting the first end of the drive shaft;

a second bearing assembly including a bearing housing for rotatably supporting a second end of the drive shaft;

a base of the compressor secured to the shell;

a mount formed on either the second bearing assembly or the base to orient the second bearing assembly relative to the base; and a spacer disposed in the bearing housing that supports the drive shaft, wherein the base includes an aperture, and the second bearing assembly is disposed at the aperture.

2. The compressor of claim 1, wherein the aperture of the base is defined by upwardly extending walls of the base.

3. The compressor of claim 2, wherein the upwardly extending walls include at least one port in communication with an interior of the shell.

4. The compressor of claim 1, wherein the second bearing assembly includes the mount, and the mount is defined by a radially outwardly extending flange of the bearing housing.

5. The compressor of claim 1, wherein the bearing housing includes at least one port in communication with an interior of the shell.

6. The compressor of claim 1, further comprising a lower bearing disposed between the bearing housing and the drive shaft.

7. The compressor of claim 1, wherein the bearing housing includes a plurality of ports in communication with an oil sump located in the shell.

8. The compressor of claim 1, wherein the base includes upwardly extending walls that define an aperture at which the second bearing assembly is fixed, the upwardly extending walls having a plurality of ports formed therein that communicate with an oil sump located in the shell.

9. The compressor of claim 8, wherein the aperture is sealed with a bottom cover plate.

10. The compressor of claim 9, wherein the bottom cover plate aligns the first bearing assembly and the second bearing assembly.

11. A compressor, comprising:

a shell;

a compression mechanism including a first scroll member having a first spiral wrap and a second scroll member having a second spiral wrap intermeshed with the first spiral wrap;

an upper bearing assembly for supporting the compression mechanism;

a drive shaft having a first end rotatably supported in the upper bearing assembly and engaged with the first scroll member for moving the first scroll member relative to the second scroll member;

a lower bearing assembly including a bearing housing for rotatably supporting a second end of the drive shaft;

a base of the compressor secured to the shell; and a mount formed on the bearing housing to orient the bearing housing relative to the base, wherein the base includes an aperture, and the lower bearing assembly is disposed at the aperture, and wherein the bearing housing includes an alignment portion to orient the base and the lower bearing assembly relative to the upper bearing assembly.

12. The compressor of claim 11, wherein the mount is defined by a radially outwardly extending flange of the bearing housing.

13. The compressor of claim 11, wherein the alignment portion is defined by a recessed portion formed in the bearing housing.

14. The compressor of claim 11, wherein the bearing housing includes at least one port in communication with an interior of the shell.

15. The compressor of claim 11, further comprising a spacer disposed in the bearing housing that supports the drive shaft.

16. The compressor of claim 11, further comprising a lower bearing disposed between the bearing housing and the drive shaft.

17. The compressor of claim 11, wherein the bearing housing includes a plurality of ports in communication with an oil sump located in the shell.

18. A compressor, comprising:

a shell;

a compression mechanism including a first scroll member having a first spiral wrap and a second scroll member having a second spiral wrap intermeshed with the first spiral wrap;

a drive shaft having a first end engaged with the first scroll member for moving the first scroll member relative to the second scroll member;

a first bearing assembly rotatably supporting the first end of the drive shaft;

a second bearing assembly including a bearing housing for rotatably supporting a second end of the drive shaft;

a base of the compressor secured to the shell;

a mount formed on the second bearing assembly to orient the second bearing assembly relative to the base, wherein the mount is defined by a radially outwardly extending flange of the bearing housing that is secured to a lower surface of the base and a spacer disposed in the bearing housing that supports the drive shaft.

19. The compressor of claim 18, wherein the bearing housing includes at least one port in communication with an interior of the shell.

20. The compressor of claim 18, further comprising a lower bearing disposed between the bearing housing and the drive shaft.

21. The compressor of claim 18, wherein the bearing housing includes a plurality of ports in communication with an oil sump located in the shell.

22. The compressor of claim 18, wherein the first bearing assembly is an upper bearing assembly for supporting the compression mechanism.

* * * * *